US008942578B2

(12) United States Patent
Kurihara

(10) Patent No.: US 8,942,578 B2
(45) Date of Patent: Jan. 27, 2015

(54) PRINTING APPARATUS, INFORMATION PROCESSING APPARATUS, AND CONTROL METHOD FOR PRINTING APPARATUS AND INFORMATION PROCESSING APPARATUS

(71) Applicant: Canon Kabushiki Kaisha, Tokyo (JP)

(72) Inventor: Shukei Kurihara, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 22 days.

(21) Appl. No.: 13/672,478

(22) Filed: Nov. 8, 2012

(65) Prior Publication Data

US 2013/0121709 A1 May 16, 2013

(30) Foreign Application Priority Data

Nov. 10, 2011 (JP) ..... 2011-246706

(51) Int. Cl.
*G03G 15/08* (2006.01)
*G03G 15/00* (2006.01)
*G03G 15/01* (2006.01)

(52) U.S. Cl.
CPC ..... *G03G 15/75* (2013.01); *G03G 15/0173* (2013.01); *G03G 15/502* (2013.01)
USPC ..... 399/27; 399/111; 399/106; 399/121

(58) Field of Classification Search
USPC ..... 399/27, 111, 227, 254, 263, 110, 119, 399/274
See application file for complete search history.

(56) References Cited

U.S. PATENT DOCUMENTS

| | | | | |
|---|---|---|---|---|
| 5,440,373 | A | 8/1995 | Deki et al. | |
| 5,617,198 | A * | 4/1997 | Ishikawa et al. | 399/27 |
| 6,850,716 | B2 * | 2/2005 | Kurihara | 399/27 |

FOREIGN PATENT DOCUMENTS

| | | | |
|---|---|---|---|
| CN | 001115423 | A | 1/1996 |
| CN | 101452240 | A | 6/2009 |
| CN | 101551609 | A | 10/2009 |
| JP | H09-090703 | A | 4/1997 |
| JP | H09-297448 | A | 11/1997 |
| JP | 2003-323027 | A | 11/2003 |

* cited by examiner

*Primary Examiner* — Walter L Lindsay, Jr.
*Assistant Examiner* — Roy Y Yi
(74) *Attorney, Agent, or Firm* — Canon USA Inc. IP Division

(57) ABSTRACT

A printing apparatus according to the present invention is a printing apparatus that performs printing using a recording material, and includes a plurality of storage units configured to store a recording material, a reception unit configured to receive designation information for specifying a storage unit to which the recording material is supplied, and a moving unit configured to move the storage unit that the designation information specifies, into a position at which the recording material can be supplied, according to an instruction.

7 Claims, 12 Drawing Sheets

FIG. 8A

| REPLACEMENT INSTRUCTION |
| --- |
| BK |
| M |

FIG. 8B

| REPLACEMENT INSTRUCTION | |
| --- | --- |
| 1 | FLAG CORRESPONDING TO BLACK TONER CARTRIDGE |
| 0 | FLAG CORRESPONDING TO YELLOW TONER CARTRIDGE |
| 1 | FLAG CORRESPONDING TO MAGENTA TONER CARTRIDGE |
| 0 | FLAG CORRESPONDING TO CYAN TONER CARTRIDGE |

PRINTING APPARATUS, INFORMATION PROCESSING APPARATUS, AND CONTROL METHOD FOR PRINTING APPARATUS AND INFORMATION PROCESSING APPARATUS

BACKGROUND OF THE INVENTION

1. Field of the Invention

The present invention relates to a printing apparatus that includes a plurality of storage units that stores recording materials to perform printing using the recording material.

2. Description of the Related Art

In a printing apparatus that is rotated to move a plurality of toner cartridges to perform printing, when toner runs out in a certain toner cartridge, the toner cartridge is moved into a replacement position, so that a user can replace the toner cartridge (Japanese Patent Application Laid-Open No. 2003-323027).

In the printing apparatus including a plurality of storage units that stores recording materials, one of the storage units is moved into a replacement position, at which the user is allowed to replace the storage unit.

However, the user does not always replace at once a storage unit which has run out of the recording material, and may replace the storage unit later. In this case, the user moves a storage unit that the user desires to replace into the replacement position, by operating, for example, a key (e.g., a toner cartridge replacement key) provided in the printing apparatus.

When the user moves the desired storage unit to the replacement position by operating the key, the user must operate the key while confirming which of the storage units is currently located at the replacement position, and therefore an operation of the key becomes troublesome.

Further, when the user moves the storage units one by one in sequence to the replacement position by operating the key, even a storage unit the user does not intend to replace may be moved to and stopped at the replacement position, which is a useless operation.

SUMMARY OF THE INVENTION

A printing apparatus according to the present invention is a printing apparatus that performs printing using a recording material. The printing apparatus includes a plurality of storage units configured to store a recording material, a reception unit configured to receive designation information for specifying a storage unit to which the recording material is supplied, from an external apparatus, and a moving unit configured to move the storage unit that the designation information specifies into a position at which the recording material can be supplied, according to an instruction.

Further, a printing apparatus according to the present invention performs printing using a recording material, and includes a plurality of storage units configured to store a recording material, a reception unit configured to receive designation information for specifying a plurality of storage units to which the recording material is supplied, from an external apparatus, and a moving unit configured to move a first storage unit among the plurality of storage units that the designation information specifies, according to an instruction, into a position at which the recording material can be supplied, and after supply of the recording material corresponding to the first storage unit has been performed, to move a second storage unit among the plurality of storage units that the designation information specifies, into the position.

Further, a printing apparatus according to the present invention performs printing using a recording material, and includes a plurality of storage units configured to store a recording material, a designation unit configured to allow a user to designate a storage unit to which the recording material is supplied, and a moving unit configured to move the storage unit designated by the user via the designation unit to a position at which the recording material can be supplied.

Further, an information processing apparatus according to the present invention is an information processing apparatus capable of communicating with a printing apparatus that includes a plurality of storage units that stores a recording material, and performs printing using the recording material. The information processing apparatus includes a designation unit configured to allow a user to designate a storage unit to which is the recording material is supplied, and a transmission unit configured to transmit designation information for specifying the storage unit designated by the user via the designation unit, to the printing apparatus, wherein the printing apparatus moves the storage unit that the designation information specifies, into a position at which the recording material can be supplied.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

FIGS. 8A and 8B illustrates examples of formats of replacement instructions.

DESCRIPTION OF THE EMBODIMENTS

Various exemplary embodiments, features, and aspects of the invention will be described in detail below with reference to the drawings.

Figure 1:
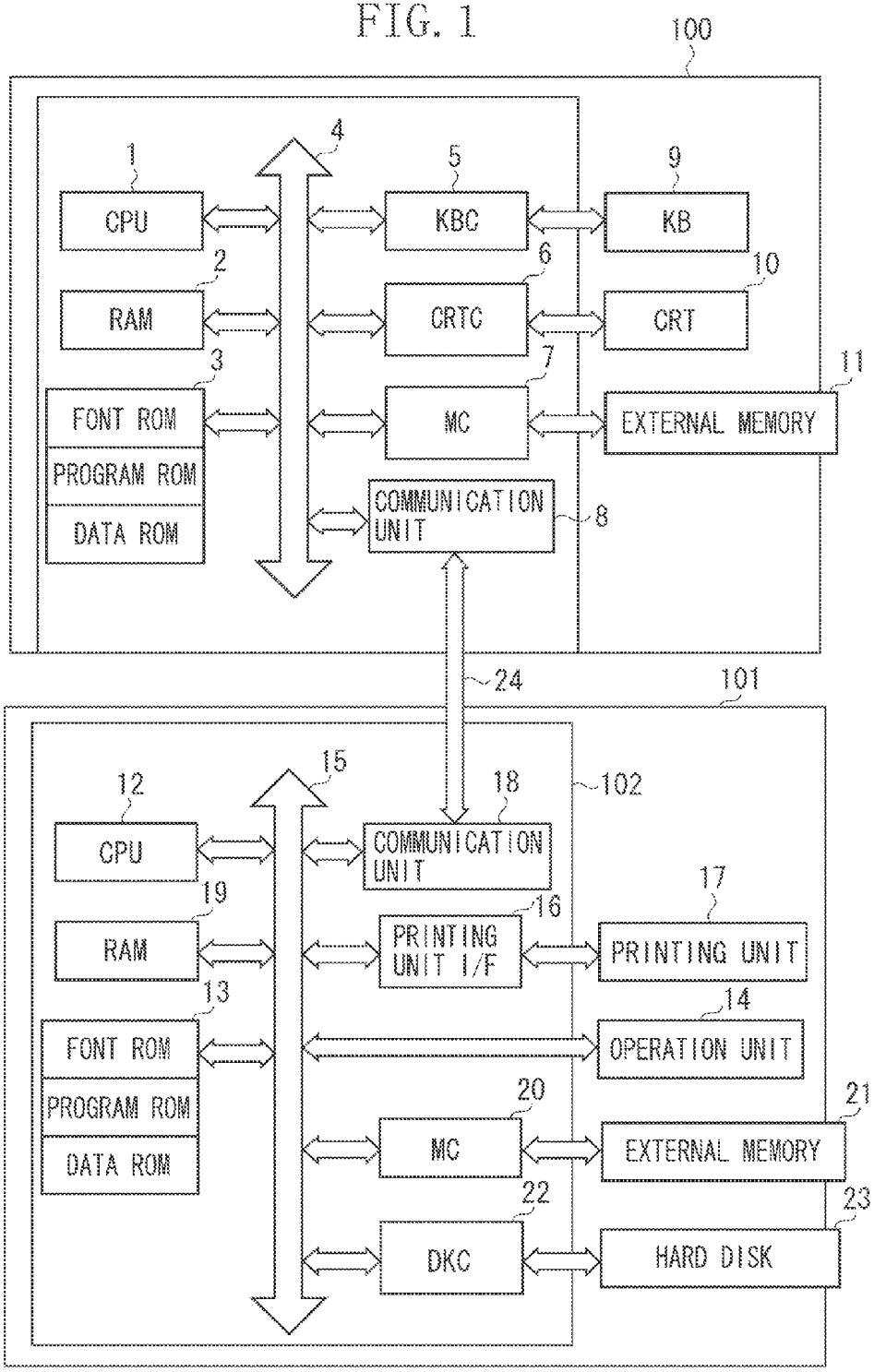
FIG. 1 is a block diagram illustrating a printing system.

FIG. 1 is a block diagram illustrating a printing system according to the present invention. In the printing system, a host computer (hereinafter, a computer) 100 and a printing apparatus 101 communicate with each other via a bidirectional interface 24. The bidirectional interface 24 may be wired such as a local area network (LAN) or a universal serial bus (USB), or wireless such as wireless LAN.

The computer 100 includes a central processing unit (CPU) 1, a random-access memory (RAM) 2, a read-only memory (ROM) 3, a system bus 4, a key board controller 5, a cathode ray tube (CRT) controller 6, a memory controller 7, a communication unit 8, a key board 9, a CRT display 10, and an external memory 11. The computer 100 acts as an information processing apparatus capable of communicating with the printing apparatus 101.

The CPU 1 performs various types of data processing, based on a program stored in a PROGRAM ROM. For example, the CPU 1 processes a document in which graphics, images, characters, tables (including, e.g., spreadsheets) and the like are included. Further, the CPU 1 comprehensively controls respective devices connected to the system bus 4. Furthermore, the CPU 1 loads outline fonts onto a display-information-RAM set up on the RAM 2, and realizes WYSIWYG (What You See Is What You Get) on a CRT display. The CPU 1 opens various types of windows, based on a command instructed by a mouse cursor on the CRT display 10, and executes various types of data processing.

The RAM 2 serves as a main memory or a working memory of the CPU 1. The ROM 3 includes a FONT ROM, a PROGRAM ROM, and a DATA ROM. The FONT ROM stores font data used in document processing. The PROGRAM ROM stores programs such as a printer selector and a network printer driver, in addition to a control program that runs on the CPU 1. The DATA ROM stores various types of data, used in document processing or the like.

The keyboard controller 5 controls key input via the key board 9 and a pointing device (not illustrated). The CRT controller 6 controls a display on the CRT display 10.

The memory controller 7 controls an access to the external memory 11. The external memory 11 is a storage device that stores a boot program, an application program, font data, a user file, and an edition file. The external memory 11 is a hard disk, a flash-electrically erasable programmable read-only memory (EEPROM), a USB memory or the like.

The communication unit 8 controls communication with the printing apparatus 101 performed via the bidirectional interface 24.

The printing apparatus 101 includes a printer controller 102, an operation unit 14, a printing unit 17, an external memory 21, and a hard disk 23. Further, the printer controller 102 includes a CPU 12, a ROM 13, a system bus 15, a printing unit interface 16, a communication unit 18, a RAM 19, a memory controller 20, and a disk controller 22.

The CPU 12 executes data processing by executing a control program stored in a PROGRAM ROM or a control program stored in the external memory 21. Further, the CPU 12 comprehensively controls various types of devices connected to the system bus 15, based on the control program. For example, the CPU 12 generates image data, and transmits image signals based on the image data to the printing unit 17 via the printing unit interface 16. Further, the CPU 12 transmits control signals to the printing unit 17 via the printing unit interface 16. Furthermore, the CPU 12 transmits information concerning the printing apparatus 101 to the computer 100 via the communication unit 18.

The ROM 13 includes the FONT ROM, the PROGRAM ROM, and the DATA ROM. The FONT ROM stores font data to be used for generating image data. The PROGRAM ROM stores control programs to be executed by the CPU 12. The DATA ROM stores various types of data used for data processing.

The operation unit 14 is an operation panel for display of information or key input, and is constituted of a switch or a light-emitting diode (LED) display unit. Also, the operation unit 14 may be a touch panel. A toner cartridge replacement key (hereinafter, a replacement key) for instructing shift to a toner cartridge replacement mode (hereinafter, a replacement mode) or movement of a toner cartridge is also provided in the operation unit 14.

The printing unit interface 16 controls communications with the printing unit 17. The communication unit 18 controls communications with the computer 100 performed via the bidirectional interface 24.

The RAM 19 serves as a main memory or a working memory of the CPU 12. A memory capacity of the RAM 19 can be expanded by adding an optional RAM to extension ports (not illustrated). Further, the RAM 19 also acts as an image data storage area for storing loaded image data, an environment data storage area for storing environment data, and a nonvolatile RAM (NVRAM) for storing various types of parameters.

The memory controller 20 controls access to the external memory 21. The external memory 21 is a storage device for storing font data, an emulation program, and form data, and is an integrated circuit (IC) card or a USB memory or the like. The external memory 21 is additionally provided as an option.

The disk controller 22 controls access to the hard disk 23. The hard disk 23 stores printing data, control programs, and the like.

Figure 2:
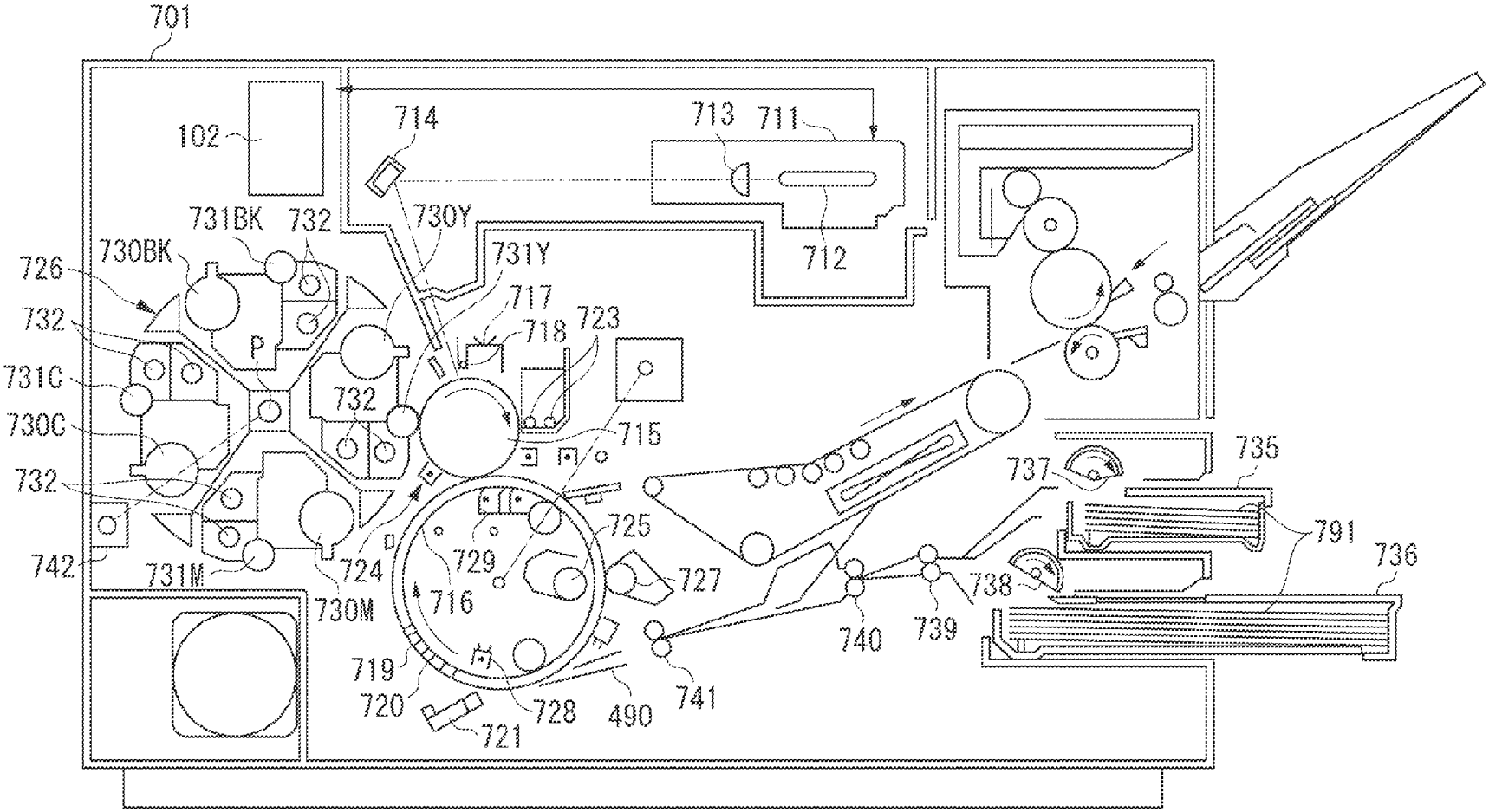
FIG. 2 is a cross-sectional view of a printing apparatus.

FIG. 2 is a cross-sectional view of the printing apparatus 101. FIG. 2 mainly illustrates an internal structure of the printing unit 17, and illustrates an internal structure of a rotation developing color laser printer of a rotary-type. In this case, a toner is used for the recording material for use in printing.

A scanner 711 includes a laser output unit (not illustrated), a polyhedral (e.g., octahedral) polygon mirror 712, a motor (not illustrated) that rotates the polygon mirror 712, and an f/.theta. lens (imaging lens) 713. The laser output unit converts an image signal from a printer controller 102 into an optical signal (laser light). The laser beam emitted from the laser output unit is reflected by the side surface of the polygon mirror 712, passes through an f/.theta. lens 713 and a reflection mirror 714, and scans line by line (raster scans) the surface of a photosensitive drum 715.

The photosensitive drum 715 rotates in the direction of an arrow as illustrated in FIG. 2. With this arrangement, an electrostatic latent image corresponding to an image which the image signal indicates is formed on the surface of the photosensitive drum 715. A primary charging device 717, a whole surface exposure lamp 718, a cleaner unit 723 that collects a toner (residual toner) not transferred to the paper sheet, and a pre-transferring charging device 724 are arranged at the periphery of the photosensitive drum 715.

A developing unit 726 is a unit that develops an electrostatic latent image, which has been formed onto the surface of the photosensitive drum 715 by laser exposure. The developing unit 726 has the configuration as described below. Note that reference symbols "C", "M", "Y" and "BK" each indicate different colors, where "C" refers to cyan, "M" refers to magenta, "Y" refers to yellow, and "BK" refers to black.

Toner cartridges 730C, 730M, 730Y and 730BK are storage units that store toners as recording materials. The remaining amounts of the toners within the toner cartridges are measured by remaining-toner-amount sensors (not illustrated). Developing sleeves 731C, 731M, 731Y and 731BK each contact the photosensitive drum 715, and perform developing using the toners. A screw 732 transports a toner stored in each of the toner cartridges 730C, 730M, 730Y and 730BK to each of the developing sleeves 731C, 731M, 731Y, and 731BK. In other words, a toner image is formed on the photosensitive drum 715, using the toner for each of cyan, magenta, yellow, and black. The toner cartridges, the developing sleeves and the screw are disposed around the central shaft P of the developing unit 726.

A cover 701 can be opened/closed, and the user can open the cover 701 to replace a toner cartridge. In the exemplary embodiment, in order to replenish a certain toner, the user replaces a toner cartridge that stores the toner. The toner cartridge that is located directly under the cover 701 is removable. Hereinafter, the position directly under the cover 701 is referred to as the "replacement position" of the toner cartridge. In FIG. 2, the toner cartridge 730BK is arranged at the replacement position. Each toner cartridge is moved into the replacement position by rotating the toner cartridges 730C, 730M, 730Y, and 730BK about the shaft P, and each toner cartridge can be replaced.

A position sensor 742 detects the rotation position of the developing unit 726. When the yellow toner image is formed on the photosensitive drum 715, a motor (not illustrated) rotates the developing unit 726 about the shaft P such that the developing sleeve 731Y is brought into contact with the photosensitive drum 715. FIG. 2 illustrates this state of the developing sleeve 731Y. When the magenta toner image is formed, the motor rotates the developing unit 726 about the shaft P, and the developing sleeve 731M is brought into contact with the photosensitive drum 715. When the cyan and black toner images are formed, the developing unit 726 operates in the same manner.

A transfer drum 716 transfers a toner image formed on the photosensitive drum 715 to a paper sheet. An actuator plate 719 detects the movement position of the transfer drum 716. A position sensor 720 is brought into close contact with the actuator plate 719 to detect the fact that the transfer drum 716 has moved to the home position.

The actuator plate 719, the position sensor 720, a transfer drum cleaner unit 725, a paper retaining roller 727, a static eliminator 728, and a transfer charging device 729 are disposed around the transfer drum 716.

Each of paper-feeding cassettes 735 and 736 accommodates paper sheets 791. For example, A4-sized paper sheets are accommodated in the paper-feeding cassette 735, and A3-sized paper sheets are accommodated in the paper-feeding cassette 736. When a paper sheet is fed and conveyed, a paper sheet is fed from the paper-feeding cassettes 735 and 736 by the paper feeding rollers 737 and 738. Timing rollers 739, 740 and 741 each perform control of the timing of paper feeding and paper conveyance. The paper sheet passes through the timing rollers 739, 740, and 741 and is guided into a paper guide 490. Then, a leading edge of the paper sheet is seized by a gripper 721, and the paper sheet is wrapped around the transfer drum 716. Whether the paper-feeding cassettes 735 or 736 is selected, is determined according to an instruction by the printer controller 102, and only a paper feeding roller corresponding to the selected paper-feeding cassette is rotated.

Through the above-described configuration, full-color printing corresponding to four colors, i.e., C, M, Y, and BK is realized.

Figure 3:
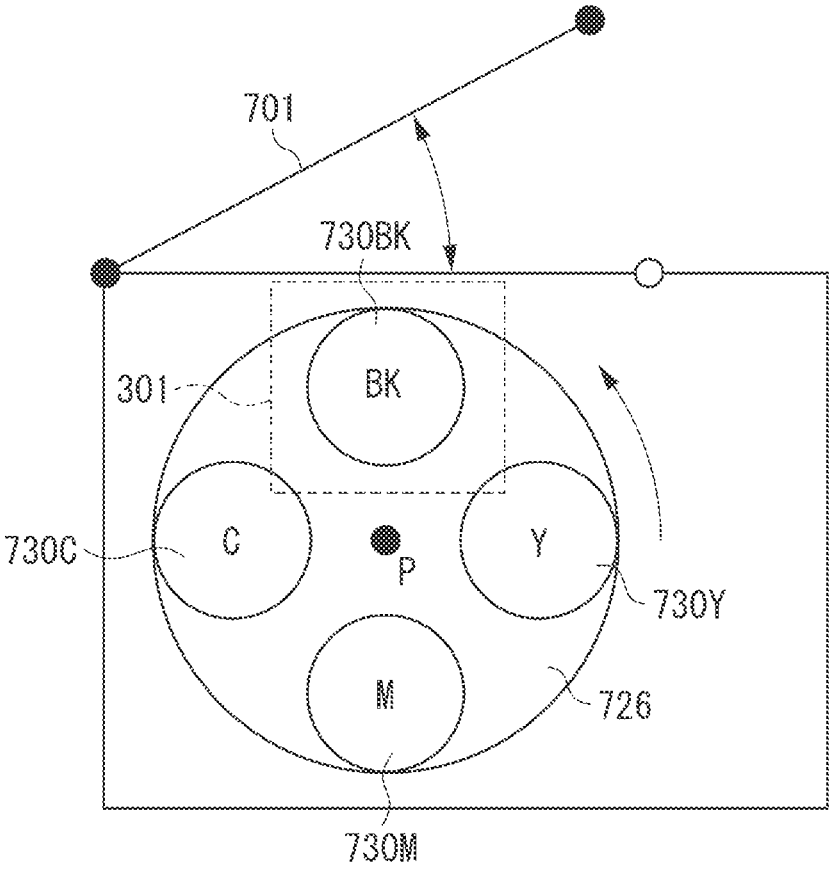
FIG. 3 is a diagram illustrating a mechanism for replacing a toner cartridge.

FIG. 3 is a diagram illustrating a framework for replacing a toner cartridge provided in a rotation developing color laser printer of a rotary-type illustrated in FIG. 2. When a toner cartridge is replaced, the user opens the cover 701. The position directly under the cover 701 which has been opened is a replacement position 301 of the toner cartridge. The user can replace the toner cartridge located at the replacement position 301. In the example of FIG. 3, the toner cartridge 730BK is replaceable. The replacement position of the toner cartridge is not limited to the position in the example in FIG. 3, but may differ depending on the construction of the printing apparatus.

The motor rotates the developing unit 726, in response to a control signal from the printer controller 102, and moves any given toner cartridge into the replacement position 301.

There are two methods for the user to move the toner cartridge into the replacement position.

In a first method, the user causes the toner cartridge to move into the replacement position using the replacement key provided in the printing apparatus 101. In the first method, when the user presses the replacement key repeatedly, the toner cartridges are moved sequentially one by one into and stopped at the replacement position.

Figure 10:
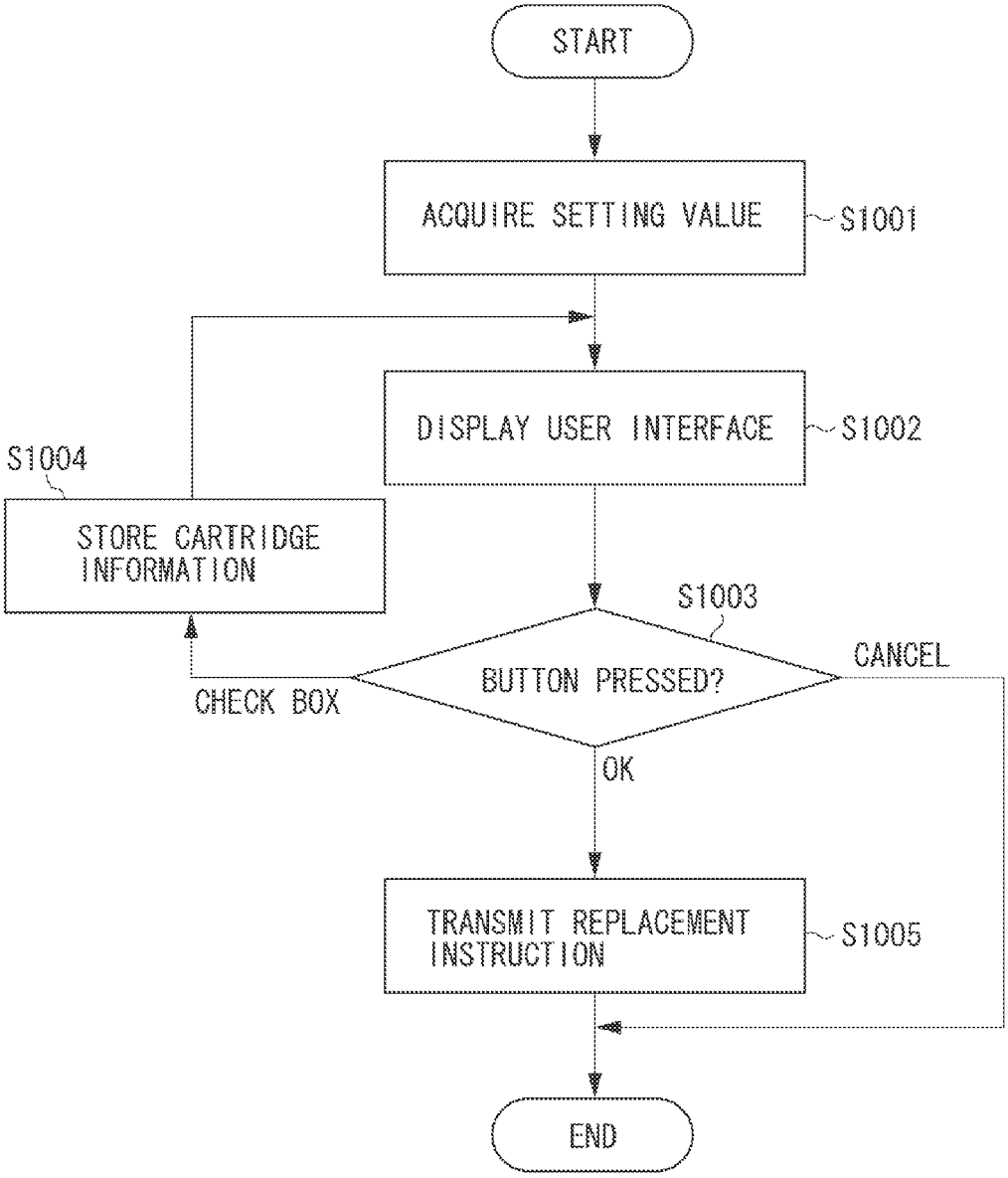
FIG. 10 is a flowchart illustrating transmission processing for transmitting a replacement instruction.
Figure 12:
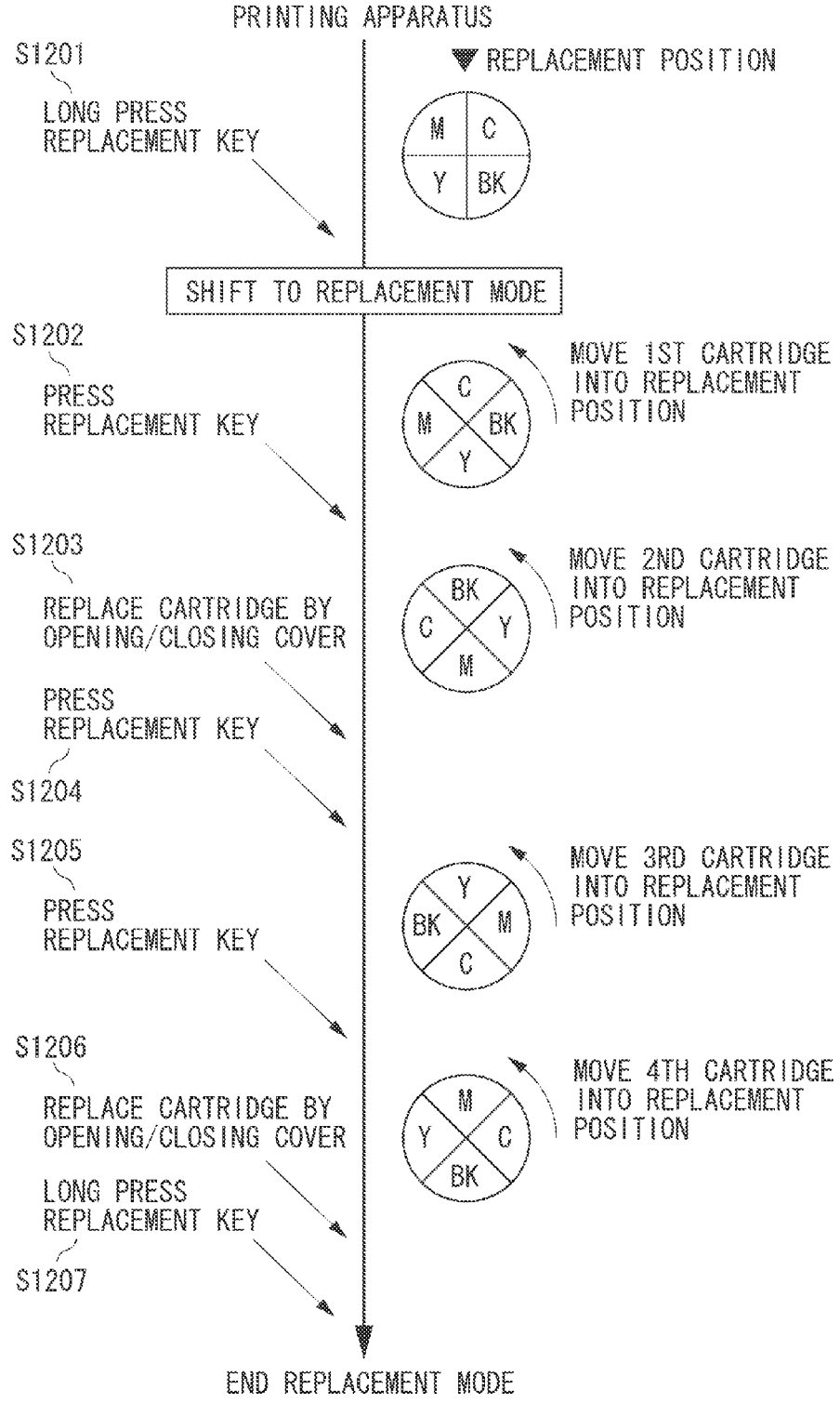
FIG. 12 is a diagram illustrating a method for moving a toner cartridge to a replacement position.

FIG. 12 illustrates the first method. FIG. 10 is a flowchart illustrating an example of replacing the toner cartridges corresponding to magenta and black.

In step S1201, a user continues to press the replacement key for a predetermined time (e.g., for five seconds) or longer, and shifts the printing apparatus 101 to the replacement mode. Then, the cyan toner cartridge closest to the replacement position is moved into the replacement position. In step S1202, the user presses again the replacement key. Then, the black toner cartridge is moved into the replacement position.

In step S1203, the user opens the cover, replaces the black toner cartridge, and closes the cover. In step S1204, the user presses again the replacement key. Then, the yellow toner cartridge is moved into the replacement position. Since the yellow toner cartridge is not a replacement target, instep S1205, the user presses again the replacement key. Then, the magenta toner cartridge is moved into the replacement position.

In step S1206, the user opens the cover, replaces the magenta toner cartridge, and closes the cover. Finally, instep S1207, the user continues to press the replacement key for a predetermined time (e.g., for five seconds) or longer, and ends the replacement mode.

In this way, the user must perform not only operation to move the magenta and black toner cartridges into the replacement position, but also operation to move the cyan or yellow toner cartridge into the replacement position. In the first method, the user must press the replacement key while thinking which toner cartridge is currently present at the replacement position, and therefore operation of the replacement key becomes cumbersome.

In the second method, the user designates one or a plurality of toner cartridges that the user desires to replace, to the printing apparatus 101 from the computer 100. Accordingly, by stopping only the toner cartridges that the user desires to replace at the replacement position, the toner cartridges can be efficiently replaced.

In particular, when a plurality of toner cartridges can be designated, the user does not need to go back and forth between the computer 100 and the printing apparatus 101.

For example, when the user designates the toner cartridges one by one via the computer 100, and replaces a plurality of toner cartridges one by one, the user needs to go back and forth so often between the computer 100 and the printing apparatus 101. For example, the user issues an instruction to the printing apparatus 101 from the computer 100 to move the black toner cartridge into the replacement position, and goes to the printing apparatus 101 to replace the black toner cartridge. Next, the user returns to the computer 100 to issue an instruction to the printing apparatus 101 from the computer 100 to move the magenta toner cartridge into the replacement position, and then goes to the printing apparatus 101 to replace the magenta toner cartridge. In the job, the user must make two round trips between the computer 100 and the printing apparatus 101.

Figure 4:
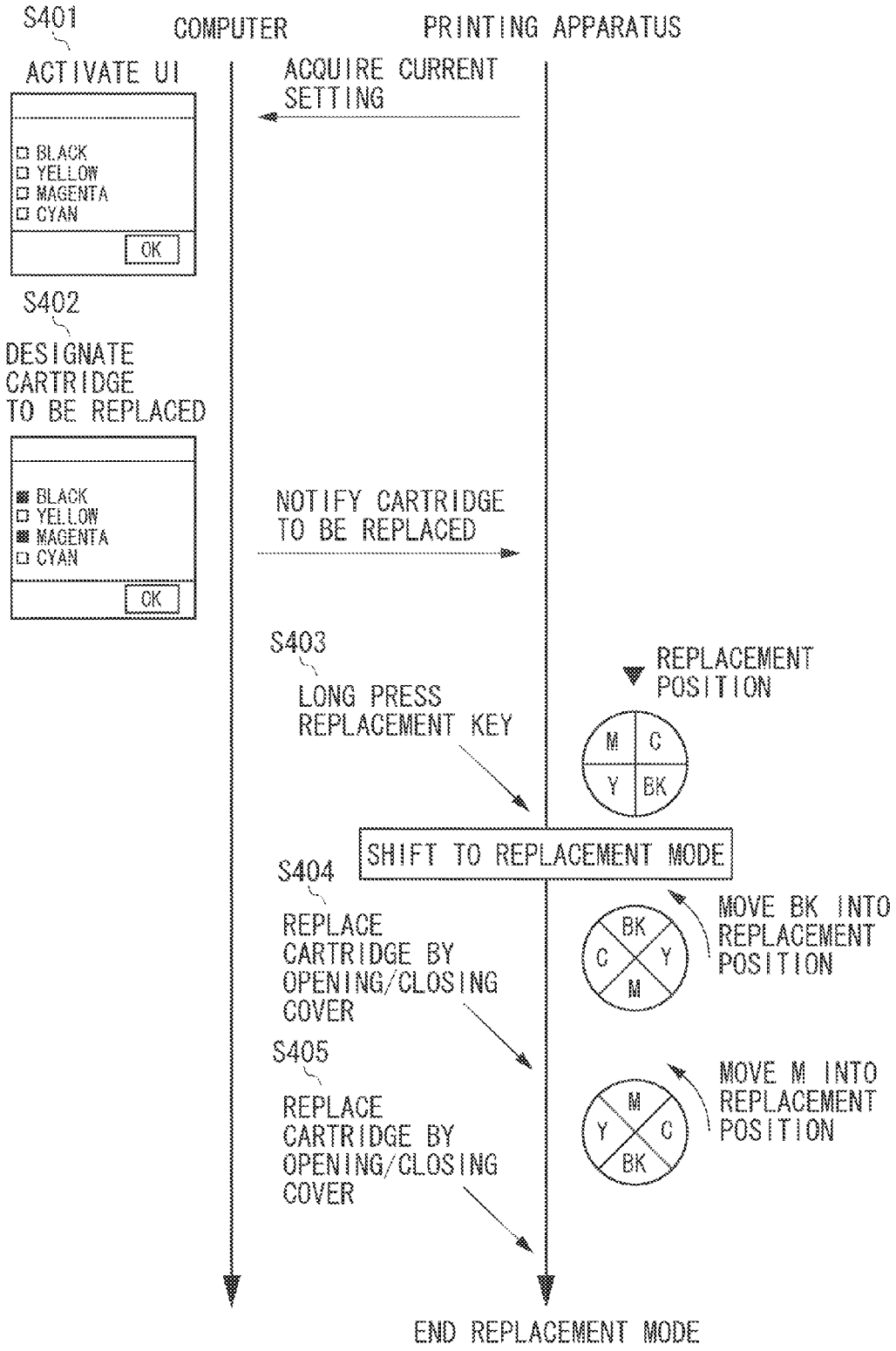
FIG. 4 is a diagram illustrating a method for moving a toner cartridge to a replacement position.

FIG. 4 illustrates the second method. FIG. 4 is a diagram illustrating an example for replacing the magenta and black toner cartridges.

In step S401, the user activates software that controls the printing apparatus 101, at the computer 100. At this time, the software acquires current setting values of the printing apparatus 101. In the setting values, a type of the toner cartridges (the toner cartridges mounted on the printing apparatus 101) replaceable by the printing apparatus 101 is included. The software makes a display indicating that the black, magenta, yellow, and cyan toner cartridges each are replaceable, based on the setting values, and displays check boxes corresponding to respective toner cartridges. In a case where the printing apparatus can perform only monochrome printing, the software makes a display indicating that the black toner cartridge is replaceable.

Figure 5:
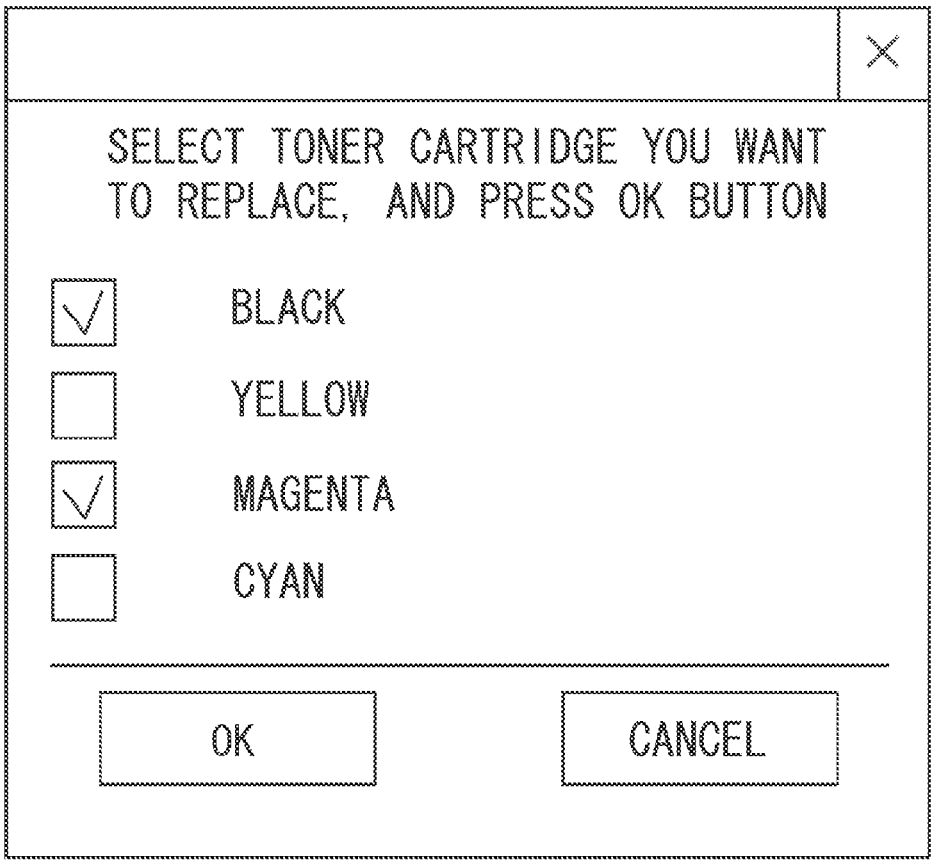
FIG. 5 illustrates an example of a user interface which the software designates.

FIG. 5 is an example of a user interface the software displays. The user can select one or a plurality of toner cartridges that the user desires to replace, in the user interface.

In step S402, the user checks each check box corresponding to black and magenta, and presses an OK button. Accordingly, the user has designated the black toner cartridge and the magenta toner cartridge as the toner cartridges of replacement targets. The software notifies the printing apparatus 101 of the fact that the black and magenta have been selected by the user.

Next, in step S403, the user moves to the front of the printing apparatus 101, and continues to press the replacement key of the printing apparatus 101 for a predetermined time (e.g., for five seconds) or longer. Then, the printing apparatus 101 shifts to the replacement mode, and moves into the replacement position the black toner cartridge among toner cartridges designated as the toner cartridge of the replacement target.

In step S404, the user opens the cover, replaces the black toner cartridge, and closes the cover. When the cover is opened and closed, the printing apparatus 101 moves into the replacement position the magenta toner cartridge among toner cartridges designated as the toner cartridge of the replacement target.

In step S405, the user opens the cover, replaces the magenta toner cartridge, and closes the cover. When the toner cartridges of the replacement targets are all replaced, the printing apparatus 101 ends the replacement mode.

Through the above operation procedure, the user can efficiently replace the toner cartridges that the user desires to replace. Since the printing apparatus 101 is informed in advance of the toner cartridges that the user desires to replace, the toner cartridges can be quickly moved into the replacement position.

Figure 6:
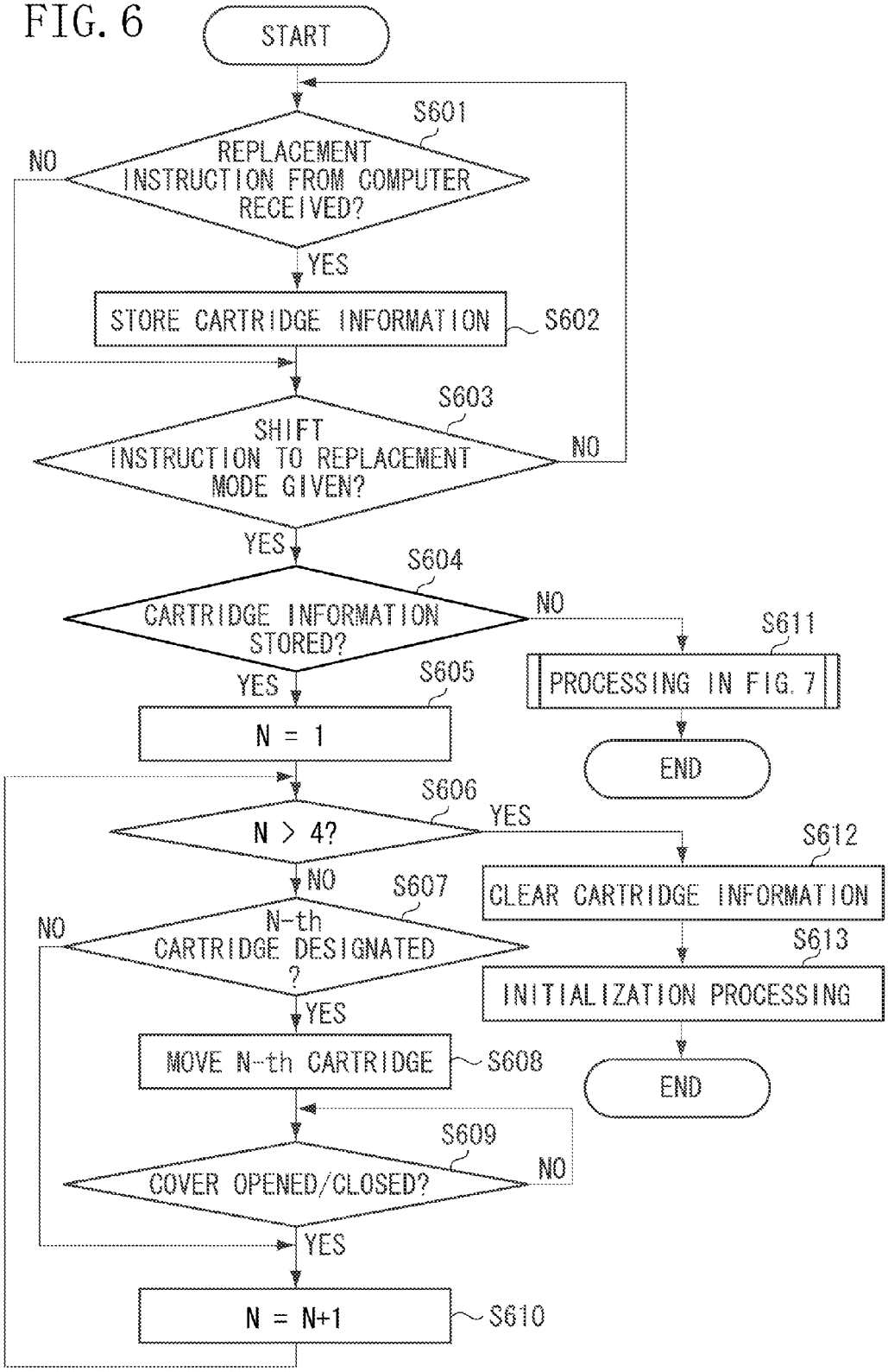
FIG. 6 is a flowchart illustrating replacement processing of a toner cartridge.
Figure 7:
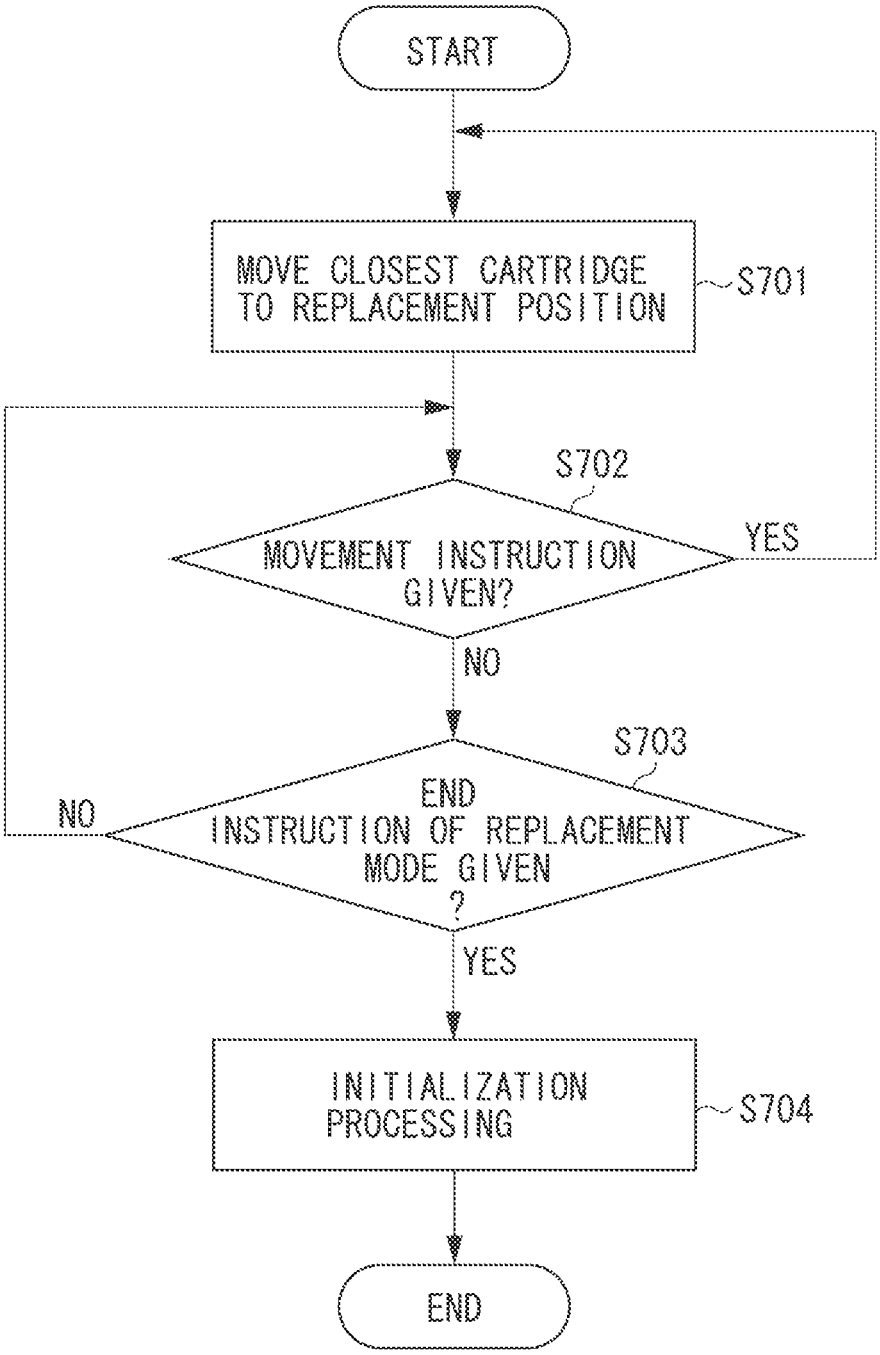
FIG. 7 is a flowchart illustrating replacement processing of a toner cartridge.

Hereinbelow, a replacement method for toner cartridges will be described using the flowchart. FIGS. 6 and 7 are flowcharts illustrating replacement processing of the toner cartridges. The processing is executed by the CPU 12 executing a program based on the flowcharts in FIGS. 6 and 7, stored in the ROM 13.

In step S601, the CPU 12 determines whether a replacement instruction of the toner cartridges from the computer 100 has been received. The replacement instruction indicates one or a plurality of toner cartridges designated as the toner cartridges of the replacement targets. If the replacement instruction from the computer 100 has not been given (NO in step S601), the processing shifts to step S603.

If the replacement instruction from the computer 100 has been given (YES in step S601), in step S602, the CPU 12 stores toner cartridge information indicating one or a plurality of toner cartridges designated via the replacement instruction, in the RAM 19. Hereinbelow, the toner cartridges for C, BK, Y, and M each are represented by N (=1 to 4).

In step S603, the CPU 12 determines whether a shift instruction to the replacement mode has been given. In the exemplary embodiment, when the replacement key continues to be pressed for a predetermined time (e.g., for five seconds) or longer, the CPU 12 determines that the shift instruction to the replacement mode has been given. If the shift instruction to the replacement mode has not been given (NO in step S603), the process returns to step S601.

If the shift instruction to the replacement mode has been given (YES in step S603), in step S604, the CPU 12 determines whether toner cartridge information is stored in the RAM 19.

If the toner cartridge information is stored in the RAM 19 (YES in step S604), in step S605, the CPU 12 sets a variable N to 1. Next, in step S606, the CPU 12 determines whether a value of the variable N is greater than 4.

If the value of the variable N is equal to or less than 4 (NO in step S606), in step S607, the CPU 12 determines whether an N-th toner cartridge is included in one or a plurality of toner cartridges the toner cartridge information indicates. In other words, the CPU 12 determines whether the N-th toner cartridge is designated as a toner cartridge of the replacement target. In the exemplary embodiment, the toner cartridge 730C is set to $1^{st}$, the toner cartridge 730BK to $2^{nd}$, the toner cartridge 730Y to $3^{rd}$, and the toner cartridge 730M to $4^{th}$ cartridge.

If the N-th toner cartridge is included in one or a plurality of toner cartridges the toner cartridge information indicates (YES in step S607), in step S608, the CPU 12 instructs the printing unit 17 to move the N-th toner cartridge into the replacement position. Then, in step S609, the CPU 12 determines whether the cover has been opened and closed. In this case, if the cover has been opened and closed, the N-th toner cartridge is determined to have been replaced.

If the cover has been opened and closed (YES in step S609), in step S610, the CPU 12 increments by 1 the value of the variable N. If the N-th toner cartridge is not included in one or a plurality of toner cartridges the toner cartridge information indicates (NO in step S607), in step S610, the CPU 12 increments by 1 the value of the variable N, without executing the processing in steps S608 and S609.

If the value of the variable N becomes greater than (YES in step S606), in step S612, the CPU 12 deletes the cartridge information from the RAM 19. Then, in step S613, the CPU 12 instructs the printing unit 17 to execute initialization processing. The printing unit 17 executes the initialization processing so that the replaced toner cartridge can be used.

If the CPU 12 determines that the cartridge information is not stored in the RAM 19 (NO in step S604), in step S611, the CPU 12 executes replacement processing of the toner cartridge, which does not use the cartridge information.

FIG. 7 is a flowchart illustrating the processing to be executed in step S611. In the replacement processing in FIG. 7, the user moves the toner cartridges one by one in order into the replacement position, by operating the replacement key.

In step S701, the CPU 12 instructs the printing unit 17 to move a toner cartridge positioned in front of the replacement position and closest to the replacement position, to the replacement position. The user, when it is necessary to replace a toner cartridge, replaces the toner cartridge.

In step S702, the CPU 12 determines whether a movement instruction of a toner cartridge has been given. In the exemplary embodiment, if the replacement key is pressed for less than a predetermined time (e.g., for five seconds), it is determined that the movement instruction of the toner cartridge has been given. If the movement instruction has been given (YES in step S702), the process shifts to step S701.

If the movement instruction has not been given (NO in step S702), in step S703, the CPU 12 determines whether end instruction of the replacement mode has been given. In the exemplary embodiment, if the replacement key continues to be pressed for a predetermined time (e.g., for five seconds) or longer in the replacement mode, it is determined that an end instruction of the replacement mode has been given.

If the end instruction has been given (YES in step S703), in step S704, the CPU 12 instructs the printing unit 17 to execute the initialization processing.

FIGS. 8A and 8B illustrate examples of formats of replacement instructions transmitted by the computer 100. In the example in FIG. 8A, the designation information for identifying toner cartridges as the replacement targets is added to the replacement instruction. BK is identification information for identifying the black toner cartridge, and M is identification information for identifying the magenta toner cartridge. In the example in FIG. 8B, the designation information indicating whether each of the toner cartridges is the replacement target is added to the replacement instruction. 1 indicates that a toner cartridge is the replacement target, and 0 indicates that a toner cartridge is not the replacement target.

The replacement instruction received in step S601 not only designates a plurality of toner cartridges which should be replaced, but also may designate their replacement sequence. In that case, the CPU 12 controls the printing unit 17 to move a plurality of the toner cartridges into the replacement position according to the designated replacement sequence. The software of the computer 100 displays a user interface via which the user can designate the replacement sequence.

Figure 9:
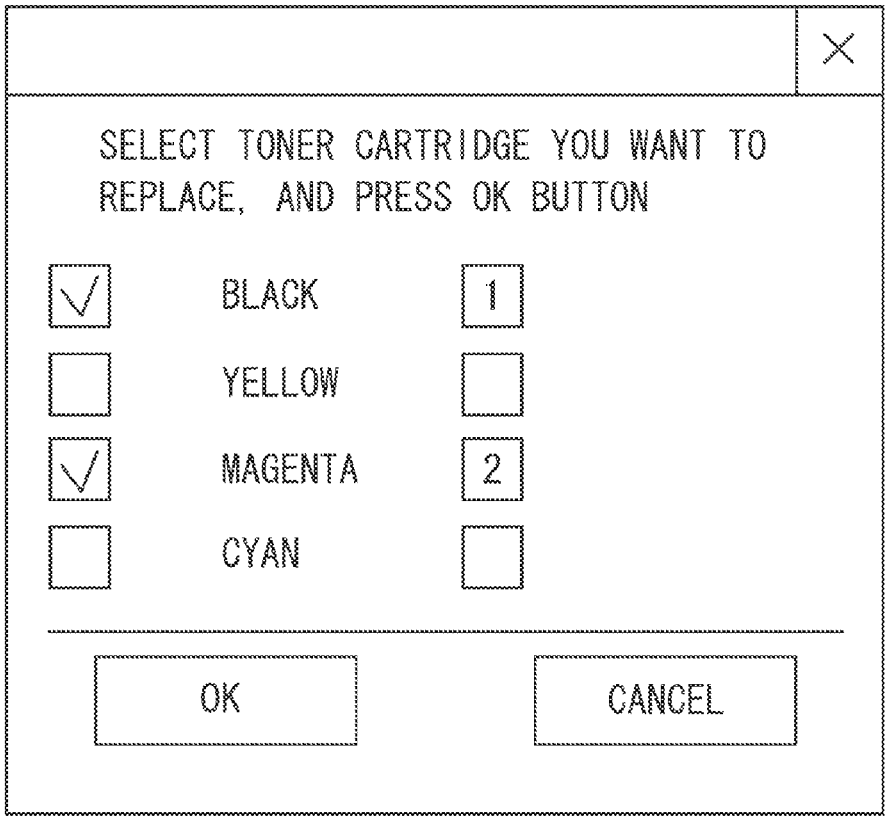
FIG. 9 illustrates an example of a user interface via which a user can designate a replacement sequence.

FIG. 9 is an example of the user interface via which the user can designate the replacement sequence. In the user interface, the user checks a check box corresponding to each toner cartridge that the user desires to replace, and inputs a replacement sequence into an input box corresponding to each of the toner cartridges that the user desires to replace. The software transmits to the printing apparatus 101 the replacement instruction to designate one or a plurality of toner cartridges that the user desires to replace and their replacement sequence, according to selection by the user.

FIG. 10 is a flowchart illustrating transmission processing for the computer 100 to transmit the replacement instruction to the printing apparatus 101. The processing is executed by the CPU 1 executing the software based on the flowchart in FIG. 10, stored in the ROM 3.

In step S1001, the CPU 1 acquires current settings of the printing apparatus 101. In the setting values, a type of the toner cartridges (the toner cartridges mounted on the printing apparatus 101) replaceable by the printing apparatus 101 is included. In step S1002, the CPU 1 causes the CRT display 10 to display the user interface illustrated in FIG. 5, based on the setting values.

The user selects one or a plurality of toner cartridges that the user desires to replace via the user interface. In step S1003, the CPU 1 determines whether a check box, an OK button or a canceling button has been pressed.

If the user presses the check box corresponding to any toner cartridge (CHECK BOX in step S1003), in step S1004, the CPU 1 stores in the RAM 2 the cartridge information indicating the toner cartridge selected by the user. Then, in step S1002, the CPU 12 causes the CRT display 10 to display the user interface on which the check box corresponding to the selected toner cartridge is checked.

If the user has pressed the OK button (OK in step S1003), in step S1005, the CPU 12 controls the communication unit 8 to transmit to the printing apparatus 101 the replacement instruction to designate one or a plurality of toner cartridges indicated by the cartridge information stored in the RAM 2. In step S1002, if the user interface illustrated in FIG. 9 is displayed, the CPU 12 controls the communication unit 8 to transmit to the printing apparatus 101 the replacement instruction to designate one or a plurality of toner cartridges that the user desires to replace, and the replacement sequence.

If the user has pressed the canceling button via the user interface (CANCELING in step S1003), the CPU 1 ends the transmission processing.

Through the processing illustrated in FIG. 10, the user can designate one or a plurality of toner cartridges of the replacement targets, on the computer 100.

In the above descriptions, the user designates one or a plurality of toner cartridges of the replacement targets on the computer 100. This has a merit that, even when the operation unit 14 cannot display an operation screen as illustrated in FIG. 5, the printing apparatus 101 can efficiently move into the replacement position one or a plurality of toner cartridges the user designates.

However, in a case where the operation unit 14 has plenty of display functions, and can display the operation screen as illustrated in FIG. 5, the user can designate one or a plurality of toner cartridges of the replacement targets, at the printing apparatus 101.

Figure 11:
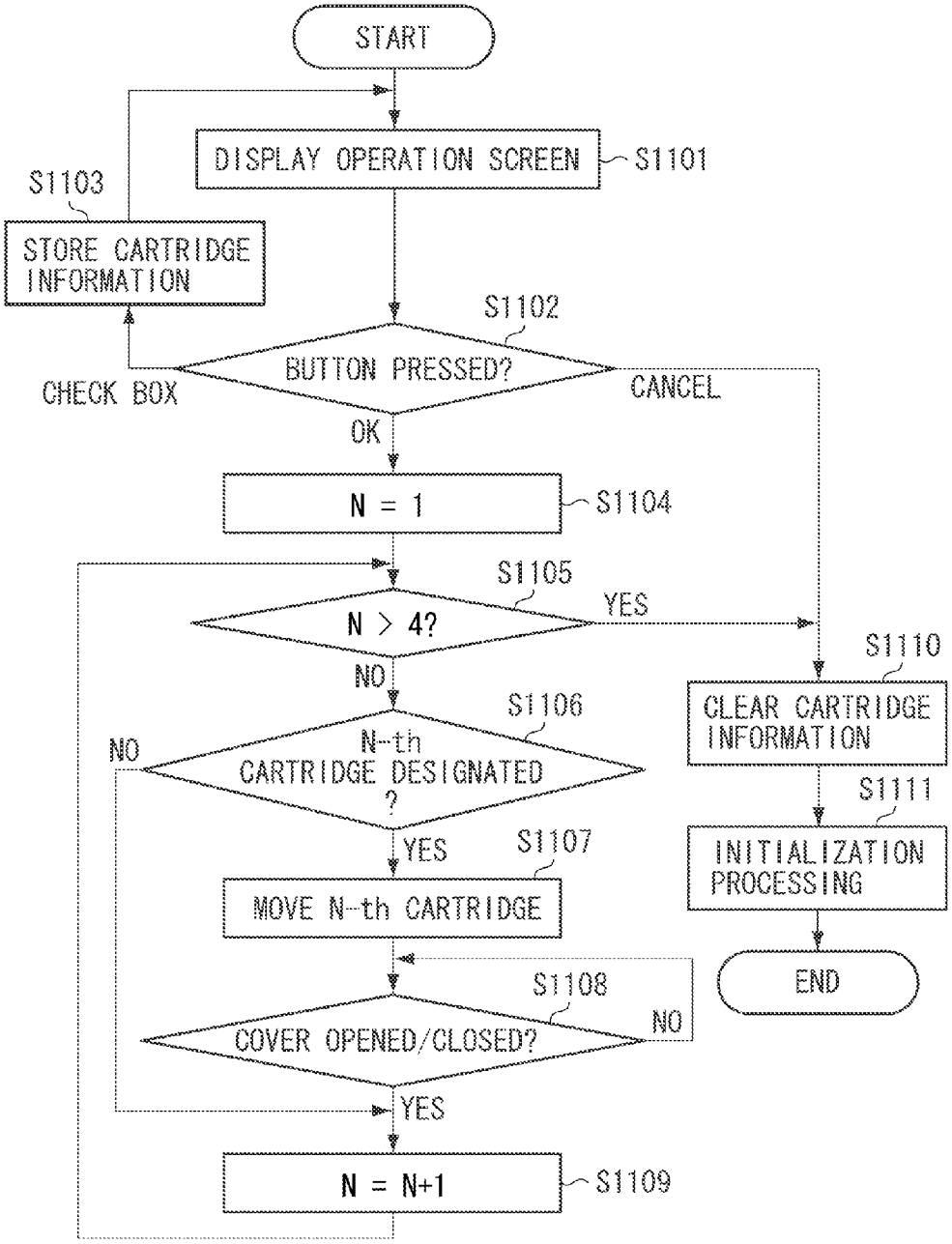
FIG. 11 is a flowchart illustrating replacement processing of a toner cartridge.

FIG. 11 is a flowchart illustrating replacement processing of toner cartridges. The replacement processing illustrated in FIG. 11 is executed in step S611, as substitute for the replacement processing illustrated in FIG. 7. The processing is executed by the CPU 12 executing a program based on the flowchart in FIG. 11, stored in the ROM 13.

In step S1101, the CPU 12 causes the operation unit 14 to display the operation screen as illustrated in FIG. 5. The user selects one or a plurality of toner cartridges that the user desires to replace via the operation screen. In step S1102, the CPU 12 determines whether a check box, an OK button, or a canceling button has been pressed.

If the user has pressed the check box corresponding to any toner cartridge (CHECK BOX in step S1102), in step S1103, the CPU 12 stores in the RAM 19 the cartridge information indicating the toner cartridges selected by the user. Then, in step S1101, the CPU 12 causes the operation unit 14 to display the operation screen on which the check boxes corresponding to the selected toner cartridges are checked.

If the user has pressed the OK button (OK in step S1102), in step S1104, the CPU 12 sets the variable N to 1. Next, in step S1105, the CPU 12 determines whether a value of the variable N is greater than 4.

If the value of the variable N is equal to or less than 4 (NO in step S1105), in step S1106, the CPU 12 determines whether an N-th toner cartridge is included in one or a plurality of toner cartridges the toner cartridge information indicates. In other words, it is determined whether the N-th toner cartridge is designated as the toner cartridge of the replacement target. In the exemplary embodiment, the toner cartridge 730C is set to $1^{st}$, the toner cartridge 730BK to $2^{nd}$ the toner cartridge 730Y to $3^{rd}$, and the toner cartridge 730M to $4^{th}$ cartridge.

If the N-th toner cartridge is included in one or a plurality of toner cartridges indicated by the toner cartridge information (YES in step S1106), in step S1107, the CPU 12 instructs the printing unit 17 to move the N-th toner cartridge into the replacement position. Then, in step S1108, the CPU 12 determines whether the cover has been opened and closed.

If the cover has been opened and closed (YES in step S1108), in step S1109, the CPU 12 increments by 1 the value of the variable N. If the N-th toner cartridge is not included in one or a plurality of toner cartridges indicated by the toner cartridge information (NO in step S1106), in step S1109, the CPU 12 increment by 1 the value of the variable N, without executing the processing in steps S1107 and S1108.

If the value of the variable N has become greater than 4 (YES in step S1105), in step S1110, the CPU 12 deletes the cartridge information from the RAM 19. Then, in step S1111, the CPU 12 instructs the printing unit 17 to execute the initialization processing. The printing unit 17 executes the initialization processing, so that the replaced toner cartridge can be used.

If the user has pressed the canceling button via the operation screen (CANCELING in step S1102), the CPU 12 does not move the toner cartridge into the replacement position, and the process proceeds to step S1110.

Through the processing illustrated in FIG. 11, the user can designate one or a plurality of toner cartridges of the replacement targets, even via the operation unit 14 of the printing apparatus 101.

The printing apparatus according to the present invention is not limited to a laser beam printer, but a printing apparatus of other printing types may be used.

In the above descriptions, a printing apparatus performs printing using toner as an example, however, the present invention can be applied to a printing apparatus that performs printing using a recording material such as ink or toner.

Supplying the recording material to a storage unit configured to store the recording material includes replacing a toner cartridge with new one, replacing an ink cartridge with new one, or replacing an ink tank with new one. Furthermore, moving the storage unit to a position where the recording material can be supplied includes moving a toner cartridge, an ink cartridge, or an ink toner to a position where they can be replaced with new ones. Further, moving the storage unit to the position where the recording material can be supplied includes moving the toner cartridge to a position where the toner can be added to the toner cartridge, moving the ink cartridge to a position where the ink can be added to the ink cartridge, or moving the ink tank to a position where the ink can be added to the ink tank.

Through the exemplary embodiment described above, the printing apparatus including a plurality of storage units that store the recording materials can more efficiently move a storage unit to which target of the recording material is supplied into a supply position.

Other Embodiments

Aspects of the present invention can also be realized by a computer of a system or apparatus (or devices such as a CPU or MPU) that reads out and executes a program recorded on a memory device to perform the functions of the above-described embodiment (s), and by a method, the steps of which are performed by a computer of a system or apparatus by, for example, reading out and executing a program recorded on a memory device to perform the functions of the above-described embodiment(s). For this purpose, the program is provided to the computer for example via a network or from a recording medium of various types serving as the memory device (e.g., computer-readable medium).

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2011-246706 filed Nov. 10, 2011, which is hereby incorporated by reference herein in its entirety.

What is claimed is:

1. A printing apparatus that performs printing using a recording material, the printing apparatus comprising:

a plurality of storage units configured to store a recording material;

a reception unit configured to receive designation information for specifying a storage unit to be replaced from an external apparatus; and a moving unit configured to move, in a replacement mode in which a storage unit which stores a recording material is replaced, the storage unit that the designation information specifies into a position at which a storage unit which stores a recording material can be replaced, in a case where the designation information has been received by the reception unit, and move a storage unit which is closest to the position, into the position, in a case where the designation information has not been received by the reception unit.

2. The printing apparatus according to claim 1, wherein the moving unit, in a case where the designation information has not been received by the reception unit, sequentially moves a plurality of storage units into the position, according to an instruction.

3. The printing apparatus according to claim 1 further comprising:

an initialization unit configured, in a case where the designation information has been received by the reception unit, after supply of the recording material corresponding to all storage units that the designation information specifies has been performed, to execute initialization processing of the storage units, and in a case where the designation information has not been received by the reception unit, to execute initialization processing, according to an instruction to end supply of the recording material.

4. The printing apparatus according to claim 1, wherein the moving unit rotates the plurality of storage units to move a storage unit into the position.

5. The printing apparatus according to claim 1, wherein the recording material is toner, and the storage unit is a toner cartridge.

6. A control method performed in a printing apparatus that includes a plurality of storage units configured to store a recording material, and performs printing using the recording material, the control method comprising:

receiving designation information for specifying a storage unit to be replaced from an external apparatus; and moving, in a replacement mode in which a storage unit stores a recording material is replaced, the storage unit that the designation information specifies into a position at which a storage unit which stores a recording material can be replaced in a case where the designation information has been received, and move a storage unit which is closest to the position, into the position, in a case where the designation information has not been received.

7. A non-transitory storage medium for storing a program readable by a computer of a printing apparatus that includes a plurality of storage units configured to store a recording material, and performs printing using the recording material, the program causing a computer to execute, receiving designation information for specifying a storage unit to be replaced from an external apparatus; and moving, in a replacement mode in which a storage unit stores a recording material is replaced, the storage unit that the designation information specifies into a position at which a storage unit which stores a recording material can be replaced in a case where the designation information has been received, and move a storage unit which is closest to the position, into the position, in a case where the designation information has not been received.

* * * * *